US008966823B1

(12) United States Patent
Van Camp

(10) Patent No.: US 8,966,823 B1
(45) Date of Patent: Mar. 3, 2015

(54) PRESS-IN SILL EXTENDER FOR THRESHOLDS

(71) Applicant: Endura Products, Inc., Colfax, NC (US)

(72) Inventor: Brent Van Camp, Kernersville, NC (US)

(73) Assignee: Endura Products, Inc., Colfax, NC (US)

( * ) Notice: Subject to any disclaimer, the term of this patent is extended or adjusted under 35 U.S.C. 154(b) by 0 days.

(21) Appl. No.: 13/975,958

(22) Filed: Aug. 26, 2013

(51) Int. Cl.
*E06B 1/70* (2006.01)

(52) U.S. Cl.
CPC ..... *E06B 1/70* (2013.01)
USPC ..... 49/467; 49/468; 52/212; 52/60; 52/217

(58) Field of Classification Search
USPC ..... 49/467, 468; 52/211, 212, 58, 60, 52/204.1, 217
See application file for complete search history.

(56) References Cited

U.S. PATENT DOCUMENTS

| | | | | | |
|---|---|---|---|---|---|
| 1,890,672 | A | * | 12/1932 | Coco | 49/467 |
| 1,910,260 | A | | 5/1933 | Reher | |
| 2,089,380 | A | | 8/1937 | Kammerer | |
| 2,273,877 | A | * | 2/1942 | Kammerer | 49/437 |
| 2,848,766 | A | | 8/1958 | Fulton | |
| 2,933,782 | A | | 4/1960 | Cornell | |
| 2,999,280 | A | | 9/1961 | Miller | |
| 3,032,837 | A | * | 5/1962 | Ramsey | 49/468 |
| 3,079,653 | A | | 3/1963 | Cornell | |
| 3,402,512 | A | * | 9/1968 | Peterson | 49/468 |
| 3,774,343 | A | | 11/1973 | Cribben et al. | |
| 3,962,828 | A | | 6/1976 | McAllister | |
| 4,185,417 | A | | 1/1980 | McKann | |
| 4,287,684 | A | * | 9/1981 | McKann | 49/468 |
| 4,411,104 | A | | 10/1983 | St. Aubin | |
| 4,447,987 | A | * | 5/1984 | Lesosky | 49/468 |
| 4,513,536 | A | | 4/1985 | Giguere | |
| 4,578,905 | A | * | 4/1986 | Hout | 49/504 |
| 4,716,683 | A | | 1/1988 | Minter | |
| 4,831,779 | A | | 5/1989 | Kehrli et al. | |
| 4,945,680 | A | | 8/1990 | Giguere | |
| 5,010,690 | A | | 4/1991 | Geoffrey | |
| 5,230,181 | A | | 7/1993 | Geoffrey et al. | |
| 5,345,722 | A | * | 9/1994 | McKann | 49/505 |
| 5,517,788 | A | | 5/1996 | McGough et al. | |
| 5,638,641 | A | | 6/1997 | Joffe et al. | |
| 5,673,517 | A | | 10/1997 | Stanclift | |
| 5,687,508 | A | | 11/1997 | Fitzhenry, Jr. et al. | |
| 5,822,931 | A | | 10/1998 | Galowitz et al. | |
| 6,138,413 | A | | 10/2000 | Fehr | |
| 6,289,635 | B1 | * | 9/2001 | Procton et al. | 49/467 |
| 6,345,477 | B1 | | 2/2002 | Kepler et al. | |
| 6,367,201 | B1 | * | 4/2002 | Massey et al. | 49/467 |
| 6,412,227 | B1 | | 7/2002 | Zen | |
| 7,266,929 | B1 | | 9/2007 | Allred et al. | |
| 7,877,940 | B2 | * | 2/2011 | Meeks et al. | 52/212 |
| 8,490,332 | B2 | * | 7/2013 | Van Camp et al. | 49/468 |

(Continued)

FOREIGN PATENT DOCUMENTS

| | | |
|---|---|---|
| GB | 2333797 | 8/1999 |

*Primary Examiner* — Jerry Redman
(74) *Attorney, Agent, or Firm* — Womble Carlyle Sandridge & Rice, LLP

(57) ABSTRACT

A threshold with a sill deck, a removable sill extender and a seal. The sill extender slides into a press-fit engagement with the sill deck such that the seal provides a press-fit connection between the sill deck and the sill extender.

15 Claims, 5 Drawing Sheets

(56) References Cited

U.S. PATENT DOCUMENTS

| | | | | |
|---|---|---|---|---|
| 8,567,128 | B2 * | 10/2013 | Van Camp et al. | 49/468 |
| 2008/0120914 | A1 | 5/2008 | Fink et al. | |
| 2008/0148645 | A1 * | 6/2008 | Rissone | 49/468 |
| 2008/0222961 | A1 * | 9/2008 | Meeks | 49/471 |
| 2010/0257789 | A1 | 10/2010 | Meeks | |
| 2010/0300001 | A1 | 12/2010 | Wernlund et al. | |
| 2012/0180397 | A1 | 7/2012 | Van Camp et al. | |
| 2012/0210650 | A1 * | 8/2012 | Rissone | 49/468 |
| 2013/0091776 | A1 * | 4/2013 | Van Camp et al. | 49/467 |

* cited by examiner

PRESS-IN SILL EXTENDER FOR THRESHOLDS

FIELD OF INVENTION

This disclosure relates to thresholds used in commercial and residential building entryways. Particularly, this disclosure relates to sill deck extensions used to increase the width of the sill deck.

BACKGROUND

Entryway systems in commercial and residential buildings often include a header jamb connected across the top of two vertical side jambs. The bottom of the entryway often includes a threshold. These thresholds typically comprise a substrate, a sill deck and a cap. The substrate provides the base of the threshold, the sill deck provides the tread surface covering the substrate, and the cap fills a channel in, or adjacent, the substrate to form a seal with the bottom of a door panel.

Depending upon the width (as defined herein) of the entryway, height of the threshold substrate and desired size of the tread surface, the sill deck can often require an extension. Extensions for sill decks are known in the art. In order to connect the existing extensions, typically a curved projection is slid along the length direction (as defined herein) of the sill deck, or rotatably connected to the sill deck. Access along the length direction requires the extension to be assembled with the sill deck prior to installing the threshold within an entryway. Once installed in the entryway, either type of extension is no longer able to detach from the sill deck without damaging surrounding components, such as the door jambs.

Heavy traffic through the entryway can dent and damage the sill deck and extension. Thus the inventors have determined that there is a need for a sill extension that is capable of removable attachment to the sill deck without the high cost and complication of removing the entire threshold.

Further, existing extensions require caulking to provide for a seal between the sill deck and the extension. Caulking provides another impediment to the removability of these existing extensions. The inventors have determined that there is also a need for a sill deck extension that provides a removably sealed connection to the sill deck.

SUMMARY OF INVENTION

This disclosure includes a first embodiment involving an improved sill extension. The sill extension has a sill extender defining a pocket formed adjacent an attachment edge thereof. The attachment edge is configured to abut the exterior side of a sill deck. The sill extension further comprises a seal within the pocket.

Another embodiment of the present disclosure provides a threshold. The threshold includes a sill deck, a sill extender, and a seal. The sill extender slides into engagement with the sill deck, the seal providing a press-fit seal between the sill deck and the sill extender.

Another embodiment of the present disclosure provides a threshold. The threshold includes a sill deck, a means for widening the sill deck, and a means for sealing the sill deck to the means for widening the sill deck.

These and other aspects of the present invention will become apparent to those skilled in the art after a reading of the following description of the preferred embodiments, when considered in conjunction with the drawings. It should be understood that both the foregoing general description and the following detailed description are exemplary and explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

As used herein, the term "front" is used to describe portions of the assembly that would be encountered first by a person viewing the entryway and threshold from the exterior side of the entryway looking inward. The same person viewing the entryway from the exterior side provides a defining reference for the terms "inner" and "outer," where an inner portion resides toward the interior relative to an outer portion.

As used herein, the term "width" is defined as the dimension along the X axis in FIGS. 1-2 and 4-5. The term "length" refers to the dimension or direction defined by the Y axis in FIGS. 1-2 and 4-5. The term "height" refers to a vertical dimension along the Z axis as defined in FIGS. 1-2 and 4-5.

Figure 1:
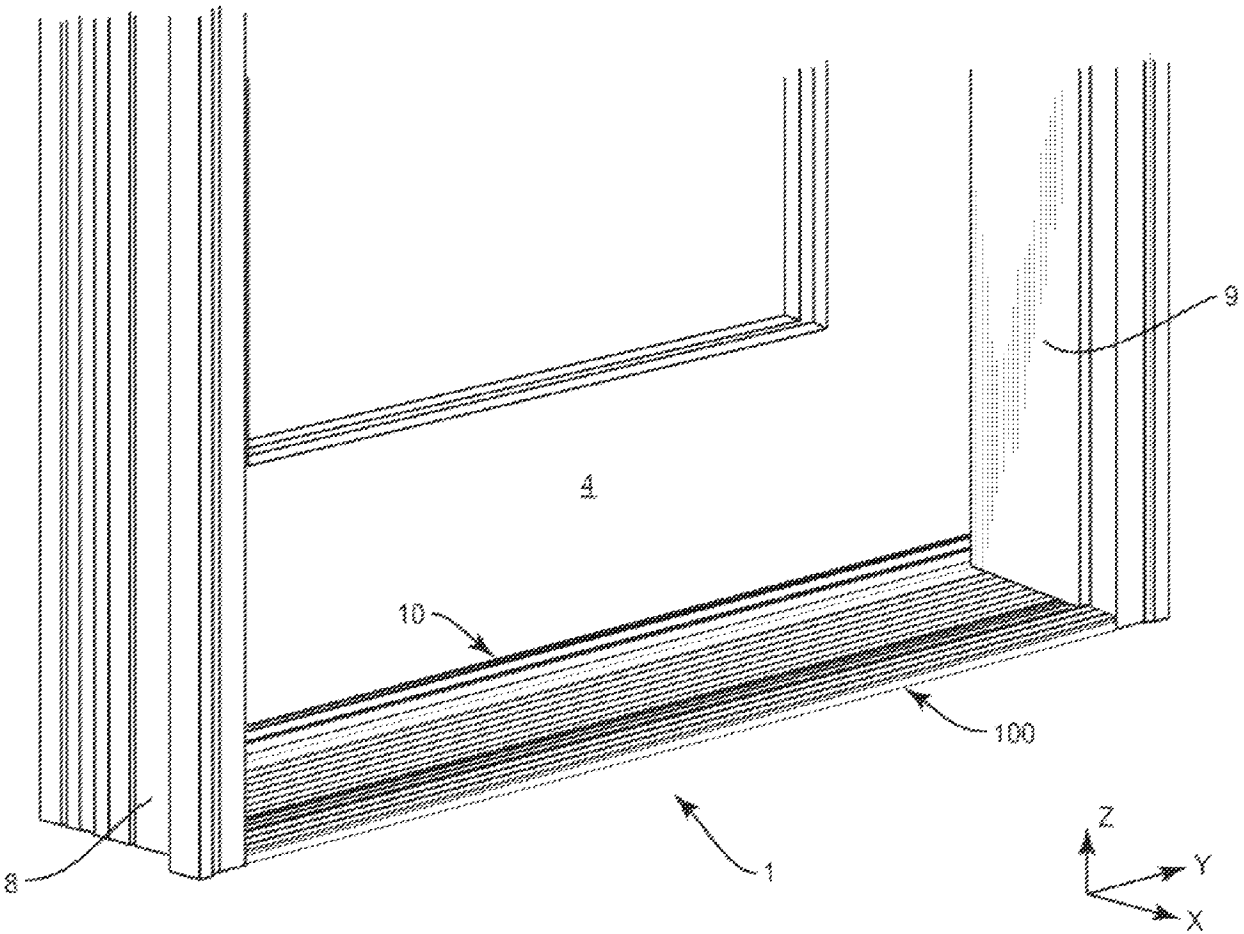
FIG. 1 shows a perspective view of an entryway according to the present disclosure.
Figure 2:
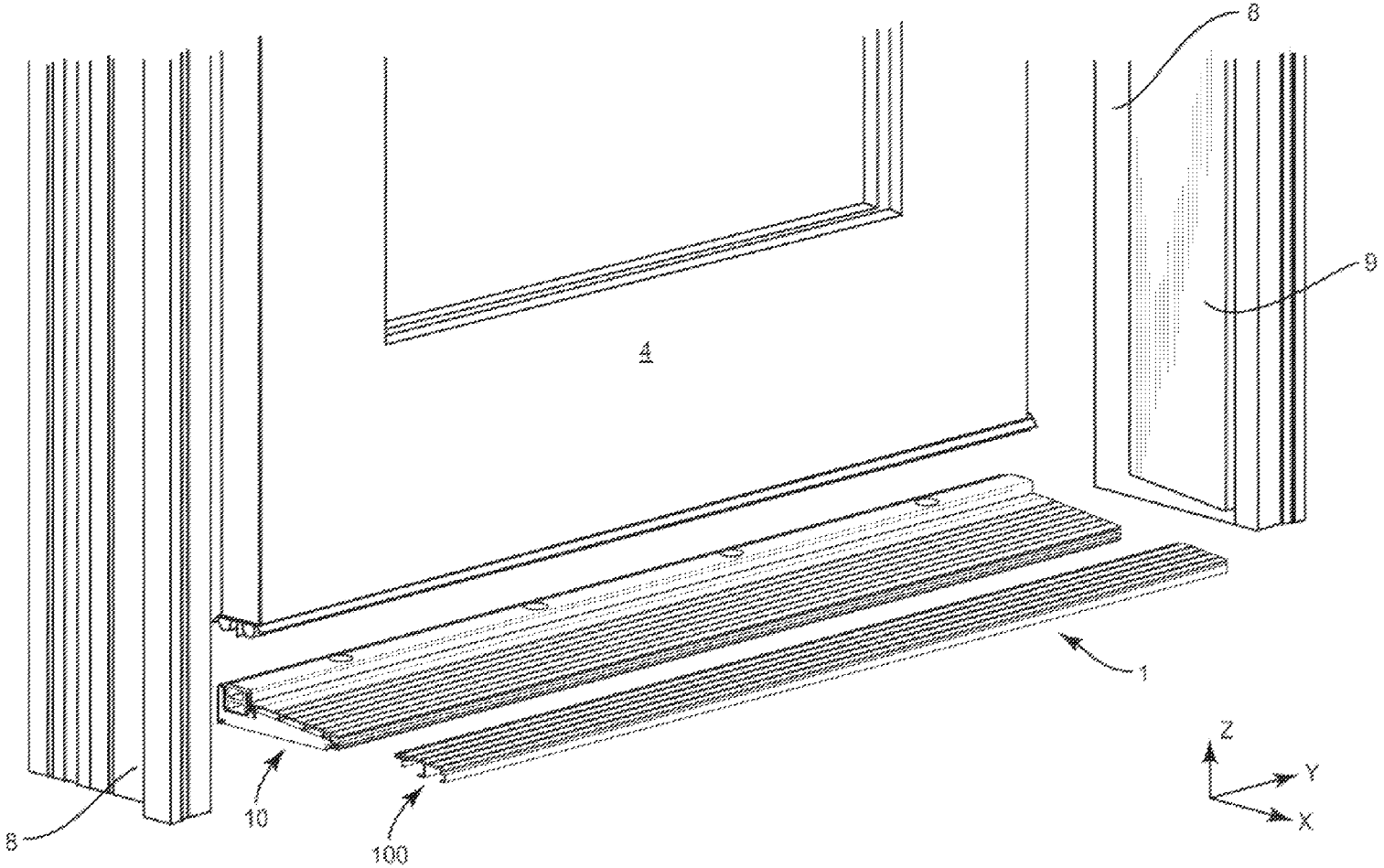
FIG. 2 shows an exploded view of the entryway of FIG. 1.

FIGS. 1 and 2 show perspective and exploded views respectively of one embodiment of an entryway 1 according to the present disclosure. The entryway 1 includes a door panel 4, side jambs 8 and a threshold 10. The threshold 10 includes an extension 100 according to the present disclosure.

Figure 3:
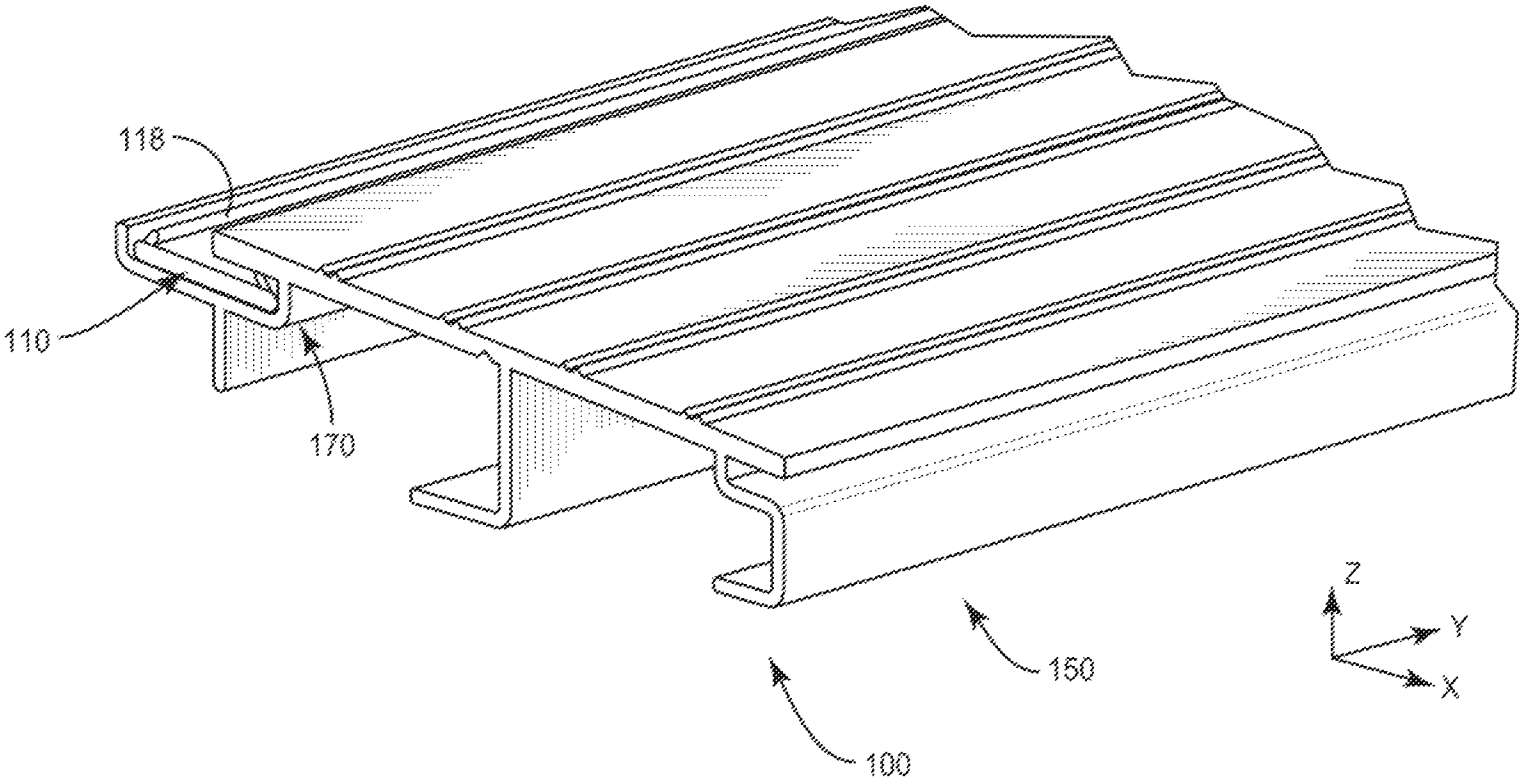
FIG. 3 shows a detailed perspective view of the sill extender of FIG. 1.

FIG. 3 shows a detailed perspective view of the extension 100 with a sill extender 150 having a pocket 170 formed at the end of the sill extender 150, and a seal 110 removably housed within the pocket 170. The sill extender 150 provides a means for widening a sill deck 50 of the threshold 10. The seal 110 provides a means for sealing the sill deck 50 with the sill extender 150.

Figure 4:
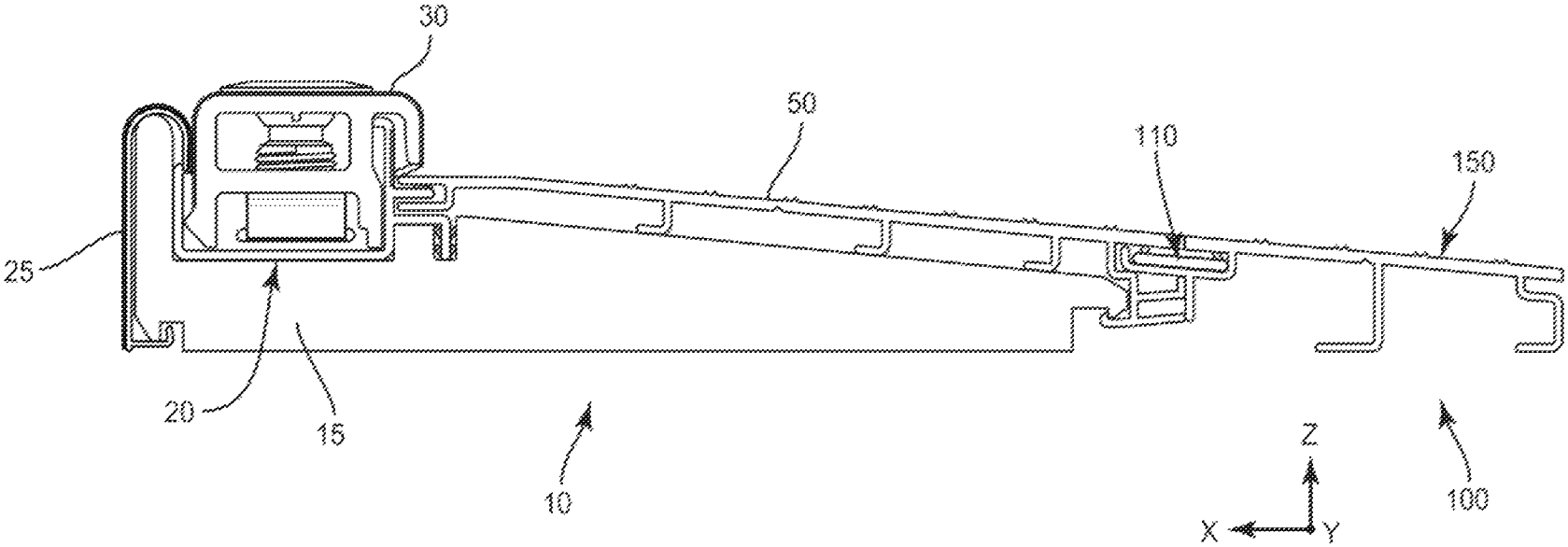
FIG. 4 shows the threshold from the entryway of FIG. 1 with the sill extender attached.
Figure 5:
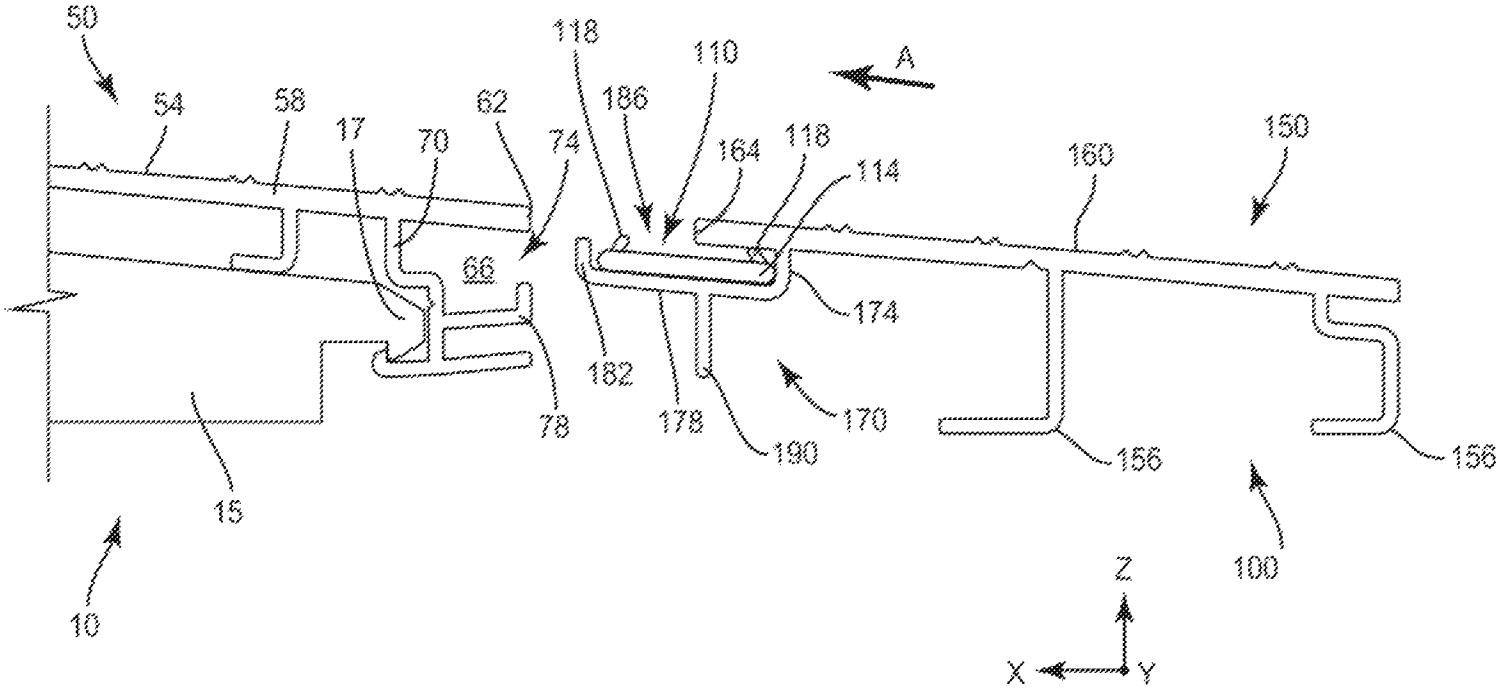
FIG. 5 shows a detailed view of the attachment region of the threshold from FIG. 3 with the sill extender detached.

FIG. 4 shows a side view of one embodiment of the threshold 10 combined with extension 100 as found in FIGS. 1 and 2. The threshold 10 includes a substrate 15, a nosing cover 25, a cap 30, and a sill deck 50. The extension 100 includes the sill extender 150 and the seal 110. FIG. 5 shows a detailed view of the connection portions between the sill extender 150 and the seal 110 unattached to the sill deck 50.

The substrate 15 may include a sill channel 20 in which the cap 30 is disposed. The sill deck 50 is configured to substantially cover the substrate 15 from at least a position adjacent to the sill channel 20 to approximate a front end 17 of the substrate 15.

The sill deck 50 defines a tread surface 54 on a tread wall 58 extending the width of the sill deck 50. The sill deck 50 may be connected to and supported by the substrate 15. An exterior front edge 62 of the sill deck 50 defines, in part, a frontward-open cavity 66. The cavity 66 should extend the length of the sill deck 50 and include a cavity opening 74 at the exterior front edge 62 of the sill deck 50. The cavity 66 can be defined by a front portion of the tread wall 58, a first projection 70 extending from the bottom of the tread wall 58 offset from the exterior front edge 62, and at least a second projection 78 extending from the first projection 70 in a direction toward the exterior front edge 62.

The sill extender 150 includes an extender tread wall 160. The extender tread wall 160 may be configured to abut, at a rear attachment edge 164, the exterior front edge 62 of the sill deck's tread wall 58 and form a continuous surface with tread wall 58. In other embodiments, the extender tread wall 160 may be offset from the tread wall 58. In either embodiment, the sill extender 150 is provided to increase the width of the threshold 10, facilitating use with a wider entryway 1 and providing a wider surface for someone to walk on or over. The extender tread wall 160 can match, in height, design, and/or spacing, the tread surface 54 of the sill deck 50. The sill extender 150 may include a plurality of support legs 156 extending from the underside of the extender tread wall 160 to support the extender tread wall 160 at the desired height. In a preferred embodiment, the extender tread wall 160 provides a downward slope away from the entryway 1. Therefore the support legs 156 may vary in height based upon their location along the width direction of the extender tread wall 160.

In at least one embodiment, the sill extender 150 comprises a pocket 170 positioned below the extender tread wall 160 and extending rearward of the rear attachment edge 164 of the extender tread wall 160. The pocket 170 may preferably extend the entire length of the sill extender 150. The pocket 170 is defined by a rear portion of the extender tread wall 160, a first wall 174 extending downwardly from the extender tread wall 160, a second wall 178 extending inwardly relative to the first wall 174, and a third wall 182 extending upward from the inward end of the second wall 178. The second wall 178 can extend substantially parallel to, and beyond the rear attachment edge 164 of the extender tread wall 160. The third wall 182 ends below the level of a plane defined by the extender tread wall 160. The pocket 170 therefore includes an upward opening 186 providing access to the pocket 170. In one embodiment, a protrusion 190 can extend downwardly from the bottom of the second wall 178.

The pocket 170 is configured to receive the seal 110. The seal 110 may be seated in a press-fit manner within the pocket 170 by inserting the seal 110 through upward opening 186. The insertion of the seal 110 within the pocket 170 may be performed on site, or the seal 110 can be preloaded within the pocket 170 when the extension 100 is sold to limit installer error. In a preferred embodiment, the seal 110 is an elongated extrusion extending substantially the full length of the threshold 10. Alternatively, the seal 110 could comprise a plurality of separate sections be disposed at discrete portions along the threshold 10, such as one section at each distal end of the threshold 10 with or without one or more sections in-between.

In one embodiment, the seal 110 has a body 114 formed of a first, relatively rigid polymer. The rigid body 114 can have a cross-sectional width substantially similar to the width of the pocket 170. The rigid body 114 may include a plurality of barbs 118 extending from at least one surface thereof. In a preferred embodiment, the barbs 118 can be formed of a second, relatively resilient, flexible polymer. The barbs 118 may extend the full length of the rigid body 114, or may extend along only a portion thereof. Preferably, the first and second polymers are co-extruded to form the rigid body 114 and barbs 118 of the seal 110. In some embodiments, the first and second materials may be selected to provide enough durability such that the seal 110 can be removed from the pocket 170 and re-used when replacing the sill extender 150. This provides a distinction with respect to caulked seal, which requires breaking the barrier and application of new caulk to form a new barrier.

The barbs 118 help provide a friction fit between the pocket 170 and the seal 110. This friction fit between the pocket 170 and seal 110 allows for removal of the seal 110, as compared to the use of caulk which creates a bonded connection with the threshold 10. At least one of the barbs 118 is configured to be exposed through the upward opening 186 when the seal 110 is disposed within the pocket 170.

In order to add the extension 100 to the threshold 10, the seal 110 may or may not need to be inserted into the pocket 170 of the sill extender 150 through upward opening 186. Once fully inserted, the seal 110 forms a friction fit inside the pocket 170 as at least one of said plurality of barbs 118 seals with the pocket 170. In the embodiment of FIG. 5, the contact occurs between the underside of the extender tread wall 160 and barb 118. In other embodiments, at least one of the barbs 118 may contact another portion of the pocket 170. The sill extender 150 should then be aligned with the length of the sill deck 50. To engage the sill extender 150 with the sill deck 50, align the pocket 170 with the cavity opening 74, and then slide the sill extender 150 generally in the width direction X (see arrow A in FIG. 5) of the entryway 1 in order to couple the pocket 170 with the cavity 66. Unlike other extenders, the need to rotate the sill extender 150 relative to the Y axis is substantially avoided. As a result, displacement of the sill extension 150 relative to the Z axis is minimized to allow the sill extender to slide under the abutment portions 9 of the side jambs 8.

One or more of the following may be used to indicate complete installation of the extension 100 onto threshold 10: one, the deck tread wall 58 abutting extender tread wall 160; two, the pocket's 170 third wall 182 contacting first projection 70; and/or three, protrusion 190 acts as an abutment surface, abutting second projection 78. At this point, in the embodiment illustrated, the at least one barb 118 of the seal 110 that was exposed through the upward opening 186 of the pocket 170 will form a press-fit connection with the underside of the deck tread wall 58.

Removal of the extension 100 can be accomplished in much the same way, by pulling the sill extender 150 away from the threshold 10 generally along the X direction. The downwardly sloped profile of extender tread wall 160 will allow the sill extender 150 to slide under the side jambs 8, increasing the clearance therebetween, as the sill extender 150 is pulled away from the sill deck 50, without damage to modification to the side jambs 8. The press-fit provided by seal 110 will allow separation between the seal 110 and the cavity 66 without the need for additional labor to break a permanent caulked edge.

The press-fit sealed connection formed between the sill deck 50 and the sill extender 150 using seal 110 allows the sill extender 150 to be added to the threshold 10 after the threshold 10 is installed between side jambs 8. Further, the press-fit connection avoids any more-permanent connection means that would require additional tools to be used when the sill extender 150 is ready to be replaced. The flexible barbs 118 provide a friction-fit that prevents inadvertent movement between the sill deck 50 and the sill extender 150. In general the extension 100 allows for removal and replacement of a worn or damaged sill extender 150 without damage, modification or removal of the side jambs 8 or the threshold 10. Further, the seal 110 can also be replaced by removing the sill extender 150 from the sill deck 50, and replacing the old seal 110 with a new one through upward opening 186 of pocket 170.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

I claim:

1. A removable extension for widening a sill deck, comprising:

a sill extender, the sill extender having a pocket formed adjacent an attachment edge thereof, the attachment edge configured to abut the exterior side of the sill deck; and a seal within the pocket;

wherein the seal includes a rigid body, wherein the rigid body comprises at least one flexible barb extending from the rigid body, wherein the rigid body and the at least one flexible barb are co-extruded using two different materials.

2. An extension according to claim 1, wherein the seal is removably press-fit within the pocket.

3. An extension according to claim 1, wherein the sill extender further comprises a tread wall, a rear end of the tread wall defining the attachment edge, configured to abut the tread wall of the sill deck, wherein the pocket is disposed below the tread wall and extends rearward of the tread wall.

4. An extension according to claim 3, wherein the pocket is a channel with an upward opening, the upward opening formed rearward of the tread wall, and the upward opening for insertion of the seal therethrough.

5. An extension according to claim 1, wherein the sill extender further comprises a protrusion extending from the pocket, the protrusion providing an abutment surface during installation of the extension into the sill deck.

6. A removable extension for widening a sill deck, comprising:

a sill extender, the sill extender having a pocket formed adjacent an attachment edge thereof, the attachment edge configured to abut the exterior side of the sill deck; and a seal within the pocket;

wherein the seal includes a rigid body, wherein the rigid body comprises at least one flexible barb extending from the rigid body, wherein the at least one flexible barb includes a first flexible barb contacting a portion of the pocket and at least a second flexible barb exposed through the pocket to contact with the sill deck.

7. An extension according to claim 6, wherein the sill extender further comprises a tread wall, a rear end of the tread wall defining the attachment edge, configured to abut the tread wall of the sill deck, wherein the pocket is disposed below the tread wall and extends rearward of the tread wall.

8. An extension according to claim 7, wherein the pocket is a channel with an upward opening, the upward opening formed rearward of the tread wall, and the upward opening for insertion of the seal therethrough.

9. An extension according to claim 6, wherein the sill extender further comprises a protrusion extending from the pocket, the protrusion providing an abutment surface during installation of the extension into the sill deck.

10. A removable extension for widening a sill deck, comprising:

a sill extender, the sill extender having a pocket formed adjacent an attachment edge thereof, the attachment edge configured to abut the exterior side of the sill deck; and a seal within the pocket, wherein the pocket is defined by a tread wall of the sill extender, the tread wall ending with the attachment edge, and first, second and third walls disposed below the tread wall, with an upward opening into the pocket present between the attachment edge of the tread wall and the third wall; and wherein the seal includes a first, rigid material forming a body and a second, resilient material co-extruded with the body to form least one flexible barb.

11. A threshold, comprising:

a sill deck;

a removable sill extender; and a seal, wherein the sill extender slides into a press-fit engagement with the sill deck, the seal providing a press-fit connection between the sill deck and the sill extender, wherein the seal is housed within a pocket formed adjacent to an attachment edge of the sill extender, wherein the seal includes a rigid body, wherein the rigid body comprises at least one flexible barb extending from the rigid body, wherein the rigid body and the at least one flexible barb are co-extruded, where the at least one flexible barb includes a first flexible barb contacting a portion of the pocket and at least a second flexible barb exposed through the pocket to contact the sill deck.

12. A threshold according to claim 11, wherein the pocket is a channel having an upward opening, the upward opening for insertion of the seal therethrough.

13. A threshold according to claim 11, wherein the sill extender is capable of engagement to the threshold before and after the sill deck is positioned between door jambs, by sliding the sill extender between side jambs of an entryway.

14. A threshold, comprising:

a sill deck;

a removable sill extender; and a seal, wherein the sill extender slides into a press-fit engagement with the sill deck, the seal providing press-fit connection between the sill deck and the sill extender, wherein the seal is housed within a pocket formed adjacent to an attachment edge of the sill extender, wherein the pocket is defined by a tread wall of the sill extender, the tread wall ending with the attachment edge, and first, second and third walls disposed below the tread wall, with an upward opening into the pocket present between the attachment edge of the tread wall and the third wall; and wherein the seal includes a first, rigid material forming a body and a second, resilient material co-extruded with the body to form at least one flexible barb.

15. A threshold according to claim 14, wherein the sill extender is capable of engagement to the threshold before and after the sill deck is positioned between door jambs, by sliding the sill extender between side jambs of an entryway.

* * * * *